US009765577B2

(12) United States Patent
Dicke

(10) Patent No.: US 9,765,577 B2
(45) Date of Patent: Sep. 19, 2017

(54) METHOD FOR MAKING PIPE CENTRALIZER HAVING LOW-FRICTION COATING

(71) Applicant: Rock Dicke Incorporated, Mason, TX (US)

(72) Inventor: Rock Dicke, Mason, TX (US)

( * ) Notice: Subject to any disclaimer, the term of this patent is extended or adjusted under 35 U.S.C. 154(b) by 516 days.

(21) Appl. No.: 14/322,072

(22) Filed: Jul. 2, 2014

(65) Prior Publication Data

US 2016/0002986 A1 Jan. 7, 2016

Related U.S. Application Data

(63) Continuation-in-part of application No. 14/249,958, filed on Apr. 10, 2014, now abandoned.

(60) Provisional application No. 61/814,434, filed on Apr. 22, 2013.

(51) Int. Cl.

| | |
|---|---|
| ***B05D 7/22*** | (2006.01) |
| ***E21B 17/10*** | (2006.01) |
| ***C23C 8/32*** | (2006.01) |
| ***E21B 33/14*** | (2006.01) |

(Continued)

(52) U.S. Cl.

CPC ..... *E21B 17/1078* (2013.01); *B05D 7/22* (2013.01); *B05D 7/222* (2013.01); *C23C 8/32* (2013.01); *C23C 12/00* (2013.01); *E21B 17/10* (2013.01); *E21B 17/1028* (2013.01); *E21B 17/1042* (2013.01); *E21B 33/14* (2013.01); *E21B 43/10* (2013.01); *B05D 2254/04* (2013.01)

(58) Field of Classification Search

CPC .. E21B 17/10; E21B 17/1042; E21B 17/1078; C23C 8/32; C23C 12/00; B05D 7/22; B05D 7/222; B05D 2254/04

USPC ..... 427/230–239

See application file for complete search history.

(56) References Cited

U.S. PATENT DOCUMENTS

| | | | |
|---|---|---|---|
| 2,228,649 | A | 6/1940 | Welles |
| 2,605,844 | A | 10/1950 | Clark, Jr. |
| 2,845,128 | A | 7/1958 | Clark, Jr. et al. |

(Continued)

FOREIGN PATENT DOCUMENTS

| | | |
|---|---|---|
| CA | 2790701 | 8/2011 |
| CA | 2849835 | 10/2015 |
| CA | 2858624 | 10/2015 |

OTHER PUBLICATIONS

"Ferritic nitrocarburizing," retrieved from Wikipedia Apr. 3, 2017, 3 pages.*

(Continued)

*Primary Examiner* — William P Fletcher, III

(74) *Attorney, Agent, or Firm* — Peter L. Brewer; Energy IP

(57) ABSTRACT

A method of fabricating a centralizer for a tubular body in a wellbore is provided herein. The method includes providing a centralizer, wherein the centralizer include an elongated body having an inner surface and an outer surface, and wherein the inner surface defines a bore there through. The bore is dimensioned to slidingly receive a tubular body. The method also includes applying a first low-coefficient of friction treatment to the inner surface and the outer surface using a ferritic nitro-carburizing process. The method further includes depositing a second low-coefficient of friction (Continued)

treatment onto at least the inner surface. The coatings are designed to provide a reduced coefficient of friction on the surfaces.

13 Claims, 8 Drawing Sheets

(51) Int. Cl.
*E21B 43/10* (2006.01)
*C23C 12/00* (2006.01)

(56) References Cited

U.S. PATENT DOCUMENTS

| | | | | |
|---|---|---|---|---|
| 2,849,071 | A | 8/1958 | Park | |
| 4,182,424 | A | 1/1980 | Prebensen | |
| 4,531,582 | A | 7/1985 | Muse et al. | |
| 4,665,996 | A | 5/1987 | Foroulis et al. | |
| 4,938,299 | A | 7/1990 | Jelsma | |
| 5,908,072 | A | 6/1999 | Hawkins | |
| 5,937,948 | A | 8/1999 | Robbins, III | |
| 6,283,205 | B1 | 9/2001 | Cannon | |
| 6,871,706 | B2 | 3/2005 | Hennessey | |
| 7,159,668 | B2 | 1/2007 | Herrera | |
| 7,694,733 | B2 | 4/2010 | Clark et al. | |
| 7,918,274 | B2 * | 4/2011 | Thornton | E21B 17/1085 166/241.2 |
| 8,096,352 | B2 | 1/2012 | Ernst et al. | |
| 8,163,401 | B2 | 4/2012 | Barnikel et al. | |
| 8,222,563 | B2 | 7/2012 | Stegemann et al. | |
| D665,825 | S | 8/2012 | Andrigo et al. | |
| D674,817 | S | 1/2013 | Andrigo et al. | |
| D674,818 | S | 1/2013 | Andrigo et al. | |
| 2008/0236842 | A1 | 10/2008 | Bhavsar et al. | |
| 2010/0276138 | A1 | 11/2010 | Wittman et al. | |
| 2011/0151238 | A1 | 6/2011 | Holly et al. | |

OTHER PUBLICATIONS

Office Action from CIPO for Canadian Application No. 2849835 dated Dec. 21, 2015.
Office Action from CIPO for Canadian Application No. 2858624 dated Dec. 22, 2015.
Office Action from Canadian Intellectual Property Office dated Nov. 15, 2016.
Article from www.victortechnologies.com re: Rock Dicke Incorporated (accessed Mar. 5, 2014) (1 page).
Article from www.dynablue.com re: Ferritic Nitrocarburizing surface treatment process (accessed Mar. 6, 2014) (3 pages).
Wikipedia article re: "Ferritic nitrocarburizing" (accessed Mar. 6, 2014) (4 pages).
Articles from www.woodworthheattreat.com re: Ferritic nitrocarburizing (accessed Mar. 6, 2014) (2 pages).
Article from www.wardsauto.com re: heat treatment process for 6m car parts (accessed Mar. 6, 2014) (3 pages).

* cited by examiner

METHOD FOR MAKING PIPE CENTRALIZER HAVING LOW-FRICTION COATING

CROSS REFERENCE TO RELATED APPLICATIONS

This application claims the benefit of U.S. Ser. No. 61/814,434, filed Apr. 22, 2013. That application was entitled "Pipe Centralizer Having Low-Friction Coating," and is incorporated herein by reference in its entirety.

This application is a continuation-in-part of U.S. Ser. No. 14/249,958, filed Apr. 10, 2014. U.S. Ser. No. 14/249,958 was entitled "Pipe Centralizer Having Low-Friction Coating."

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

FIELD OF THE INVENTION

The present disclosure relates to the field of hydrocarbon recovery operations. More specifically, the present invention relates to pipe centralizers such as may be used to centralize a casing string within a wellbore.

TECHNOLOGY IN THE FIELD OF THE INVENTION

In the drilling of oil and gas wells, a wellbore is formed using a drill bit that is urged downwardly at a lower end of a drill string. After drilling to a predetermined depth, the drill string and bit are removed and the wellbore is lined with a string of casing. An annular area is thus formed between the string of casing and the surrounding formations.

A cementing operation is typically conducted in order to fill or "squeeze" the annular area with cement. The combination of cement and casing strengthens the wellbore and facilitates the isolation of formations behind the casing.

It is common to place several strings of casing having progressively smaller outer diameters into the wellbore. The process of drilling and then cementing progressively smaller strings of casing is repeated several times until the well has reached total depth. The final string of casing, referred to as a production casing, is cemented in place. This is a tubular body that resides adjacent one or more producing reservoirs, or "pay zones." The production casing is frequently in the form of a liner, that is, a tubular body that is not tied to the surface, but is hung from a next lowest string of casing using a liner hanger. In either instance, the production casing is perforated to provide fluid communication between the reservoir and the production tubing.

In connection with setting casing strings within a wellbore, it is desirable that the casing strings be centered within the wellbore. In this way, the cement can flow evenly around the casing string, creating a more uniform barrier around the casing within the wellbore. This, in turn, helps to seal the annular area from fluid flow, providing sealing integrity between surrounding subsurface formations.

In order to center the casing string, it is known to use so-called centralizers. Centralizers are generally tubular bodies having an inner diameter that lightly engages the outer diameter of a casing string, meaning that the centralizers direct or maintain the casing string generally concentrically within the wellbore as the casing string is run into the hole and when the casing is set. Traditionally, centralizers have employed a pair of rings, or collars, that are separated by bow springs. The centralizers are clamped to the pipe during the run-in process using end collars that are hinged. In this respect, the centralizer collars are opened to mount to the pipe, and are then closed and secured around the pipe. Examples of such centralizers are shown and described in U.S. Pat. No. 2,605,844 ("Casing Centralizer"); U.S. Pat. No. 2,845,128 ("Casing Centralizer and Wall Scratcher"); U.S. Pat. No. 2,849,071 ("Casing Centralizers") and U.S. Pat. No. 4,531,582 ("Well Conduit Centralizer").

The process of running in a casing string with centralizers causes significant friction to occur between the bow springs (sometimes referred to as leaf springs) and the surrounding rock formation. This is in the form of drag friction. In addition, with the ever-increasing use of lateral and horizontal wellbores, bow springs are being asked to support a casing string that is being pushed laterally through a rock formation. In this respect, the casing strings are pushed through a deviated wellbore portion, and then in some cases across an extended substantially horizontal portion. The horizontal portion may extend for thousands of feet.

In order to increase the durability of the centralizer, it has been suggested to use a solid-body casing centralizer fabricated from millable carbon steel. TDTech, Ltd. of New Zealand offers such as a centralizer, known as a Sidewinder™. The Sidewinder™ tool employs so-called ridge-riding collars that enable a casing string to ride over ridges in the wellbore.

To enhance the ability of joints of drill string to move through a wellbore during drilling, it has also been suggested to use sleeves coated with a pliable material. U.S. Pat. No. 4,182,424 ("Drill Steel Centralizer") discloses such a centralizer. Rubber or plastic sleeves with blades that are rigid enough to take the impacts during string delivery have also been used as illustrated in U.S. Pat. No. 4,938,299 ("Flexible Centralizer"); U.S. Pat. No. 5,908,072 ("Non-Metallic Centralizer for Casing"); U.S. Pat. No. 6,283,205 ("Polymeric Centralizer"); and U.S. Pat. No. 7,159,668 ("Centralizer"). However, this adds complexity and expense to the manufacturing process and does nothing to reduce friction along surfaces contacting casing joints.

U.S. Patent Publication No. 2008/0236842, entitled "Downhole Oilfield Apparatus Comprising a Diamond-Like Carbon Coating and Methods of Use," discloses the use of DLC coatings on downhole devices. However, DLC coatings are generally cost prohibitive for centralizers. Recently, companies have begun offering centralizers fabricated from plastic materials. However, it is believed that these products do not have the durability needed for extended reach lateral/horizontal wellbores.

A need exists for a centralizer having a reduced coefficient of friction along an inner surface. This allows a casing string or a string of drill pipe to rotate and translate between the casing collars more freely. Further, a need exists to offer a centralizer design having a low-coefficient of friction coating along at least the inner surface, and preferably also along the outer surface. Still further, a need exists for a centralizer design having a coefficient of friction that is less than about 0.15.

BRIEF SUMMARY OF THE INVENTION

A centralizer for a tubular body is first provided herein. The centralizer is designed to be placed in a wellbore, such as a wellbore being completed for the production of hydrocarbon fluids.

In one aspect, the centralizer includes an elongated body having a bore there through. The bore is dimensioned to receive a tubular body such as a joint of casing. Preferably, the centralizer defines a substantially solid body having an inner surface and an outer surface. The outer surface defines centralizing members such as blades disposed equi-distantly around the outer surface.

The centralizer also has a coating deposited on the inner surface, or a layer formed as the inner surface. The coating or layer is designed to provide a highly reduced coefficient of friction. The inner surface may comprise, for example, (i) polytetrafluoroethylene (PTFE), (ii) perfluoroalkoxy polymer resin (PFA), (iii) fluorinated ethylene propylene copolymer (FEP), (iv) ethylene chlorotrifluoroethylene (ECTFE), (v) a copolymer of ethylene and tetrafluoroethylene (ETFE), (vi) polyetheretherketone, (vii) carbon reinforced polyetheretherketone, (viii) polyphthalamide, (ix) polyvinylidene fluoride (PVDF), (x) polyphenylene sulphide, (xi) polyetherimide, (xii) polyethylene, or (xiii) polysulphone.

Alternatively, the coating may comprise, for example, graphite, Molybdenum disulfide ($MoS_2$), hexagonal Boron Nitride (hBN), or combinations thereof.

In one aspect, the low-friction layer resides only on the inner surface of the centralizer. This provides for significantly reduced friction relative to a casing wall, allowing the casing to rotate and translate relative to the centralizer as a casing string is run into a wellbore while still being centralized. In another aspect, the layer also resides along blades on the outer surface of the centralizer. This reduces drag friction and abrasion as the casing with attached centralizers is run into the wellbore.

In one aspect, the coating first comprises a nitrogen-enriched coating applied on all surfaces. The coating is applied using a ferritic carburizing method, and comprises a first coating. Thereafter, a second coating of graphite, Molybdenum disulfide ($MoS_2$), hexagonal Boron Nitride (hBN), polytetrafluoroethylene (PTFE) or combinations thereof is deposited. This may be applied using a spraying or painting process.

A method of manufacturing a centralizer is also provided herein. The method may first include providing a centralizer. The centralizer may have been formed, for example, from a milling process. Preferably, the centralizer comprises a metal material such as steel, though it may alternatively comprise ceramic. As an alternative, a molding process may be employed.

The method further involves placing the centralizer into a deposition chamber. The chamber preferably comprises one or more nozzles used for vapor deposition, such as physical vapor deposition wherein thin layers of metal are bonded onto the surfaces of the centralizer. Physical vapor deposition may include the disbursement of an atomized gaseous material into the chamber, with the atoms impregnating the centralizer surfaces at high temperatures. Here, the vapor is injected through one or more atomizing nozzles.

The method optionally includes heating the chamber. Preferably, the chamber is heated to a temperature of at least 750° F. More preferably, the temperature in the chamber is raised to between about 950° F. and 1,150° F. prior to or during the deposition process. The processing of heating the chamber also heats the metal material making up the centralizer.

In another aspect, the surfaces of the centralizer are heated using a plasma torch. The plasma torch enables heating of the downhole device to a very high temperature, even in excess of 2,500° F.

The method further optionally includes lowering the pressure in the chamber during deposition. In one aspect, the pressure is lowered to between about one and ten torrs. This assists the deposition process.

The method also includes directing a vapor or gaseous material through the nozzles and onto the surfaces of the centralizer. Preferably, a gaseous mixture comprising nitrogen and carbon is injected through the one or more nozzles. The inert gas atoms locate onto the centralizer structure through a nitro-carburizing process. Further, and as a result of the heating, the metal material making up the centralizer expands, allowing the gaseous mixture to penetrate into the metal material as nano-particles.

It is preferred that the heating and vapor deposition process be conducted over a period of about one hour. Preferably, a ferritic nitro-carburizing process is employed that produces a polytetrafluoroethylene (PTFE) coating on all surfaces of the centralizer. Thereafter, the deposition chamber is allowed to cool. As the centralizer cools within the deposition chamber, the inert nano-particles become trapped or embedded into the metal material. In this way, a low-friction coating is formed.

The deposition process results in a first coating being formed. In accordance with certain aspects of the method, a second coating is also provided over the first coating. The second coating consists of graphite, Molybdenum disulfide ($MoS_2$), hexagonal Boron Nitride (hBN), or combinations thereof. This may be applied using a spraying or painting process, preferably at ambient conditions.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

DETAILED DESCRIPTION OF CERTAIN EMBODIMENTS

Definitions

For purposes of the present application, it will be understood that the term "hydrocarbon" refers to an organic compound that includes primarily, if not exclusively, the elements hydrogen and carbon. Hydrocarbons may also include other elements, such as, but not limited to, halogens, metallic elements, nitrogen, oxygen, and/or sulfur.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions or at ambient conditions (15° C. or 20° C. and 1 atm pressure). Hydrocarbon fluids may include, for example, oil, natural gas, coalbed methane, shale oil, pyrolysis oil, pyrolysis gas, a pyrolysis product of coal, and other hydrocarbons that are in a gaseous or liquid state.

As used herein, the term "wellbore fluids" means water, mud, hydrocarbon fluids, formation fluids, or any other fluids that may be within a string of drill pipe during a drilling operation.

As used herein, the term "subsurface" refers to geologic strata occurring below the earth's surface.

The term "low-friction coating," or "low coefficient of friction coating," refers to a coating for which the coefficient of friction is less than 0.15.

As used herein, the term "wellbore" refers to a hole in the subsurface made by drilling or insertion of a conduit into the subsurface. A wellbore may have a substantially circular cross section, or other cross-sectional shapes. The term "well," when referring to an opening in the formation, may be used interchangeably with the term "wellbore." Note that this is in contrast to the terms "bore" or "cylinder bore" which may be used herein, and which refers to a bore in a tool.

DESCRIPTION OF SELECTED SPECIFIC EMBODIMENTS

Figure 1A:
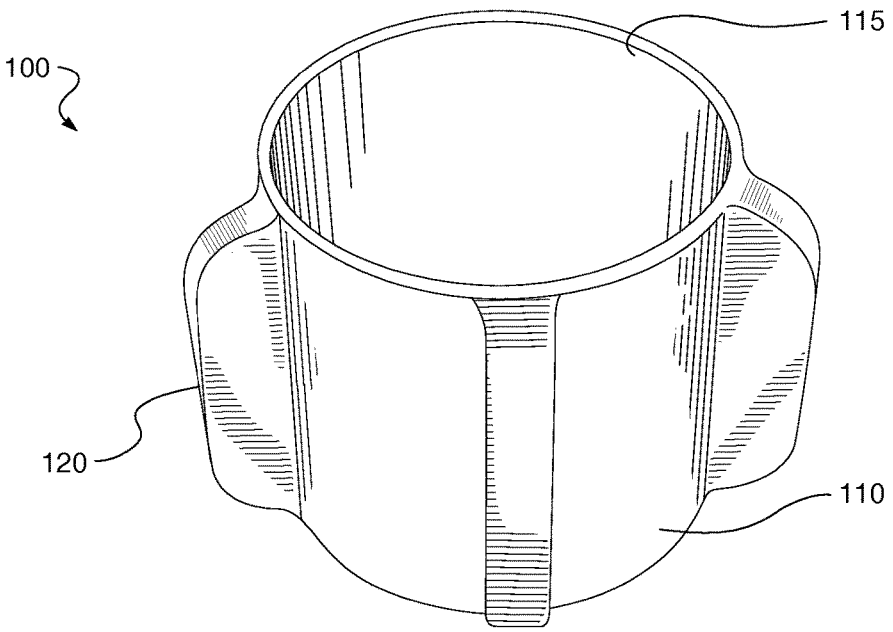
FIG. 1A is a perspective views of a centralizer as may be used in the present invention, in one embodiment. The centralizer may be used for centering a tubular body such as a joint of casing, a liner, a joint of drill string, an injection tubing, or a sand screen in a wellbore.
Figure 1B:
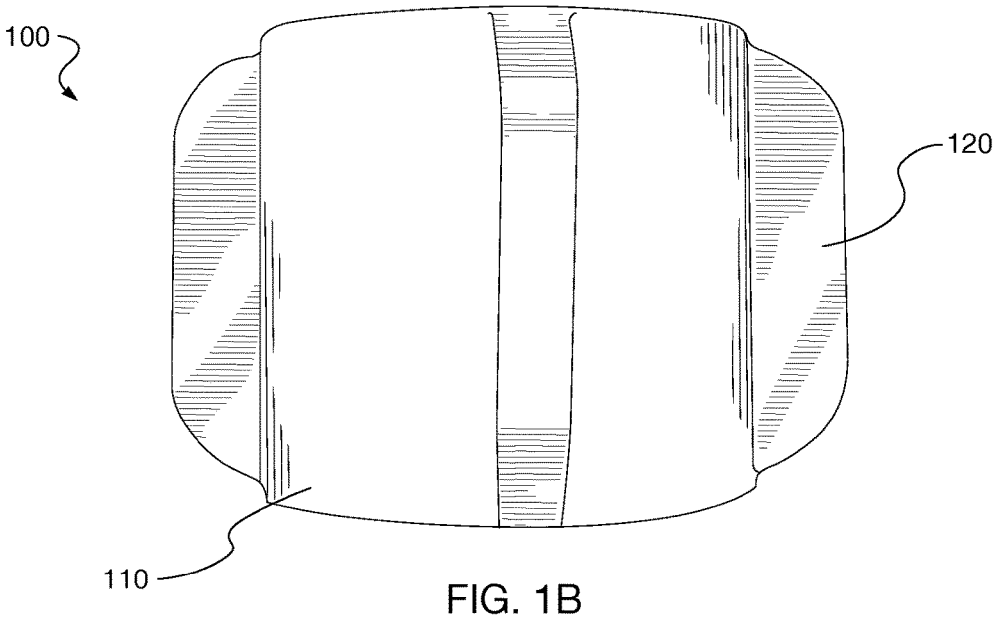
FIG. 1B is a side view of the centralizer of FIG. 1A.

FIG. 1A is a perspective view of a centralizer 100 as may be used in the present invention, in one embodiment. The centralizer 100 may be used for centering a tubular body such as a joint of casing, a liner, a joint of drill pipe, a production tubing, an injection tubing, or a sand screen in a wellbore. The centralizer 100 has an outer surface 110 and an inner surface 115. FIG. 1B is a side view of the centralizer 100.

Figure 2A:
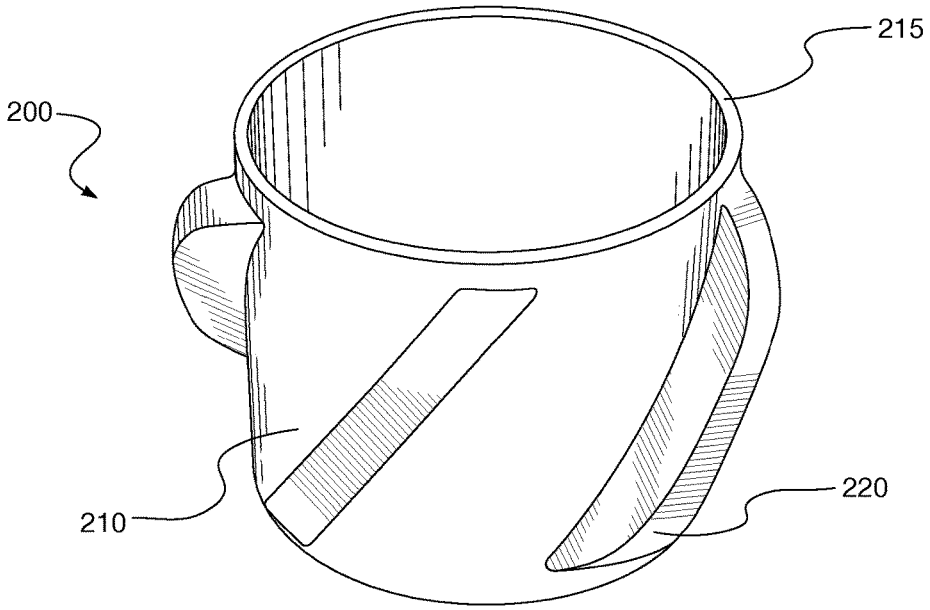
FIG. 2A is a perspective view of a casing centralizer as may be used in the present invention, in an alternate embodiment.
Figure 2B:
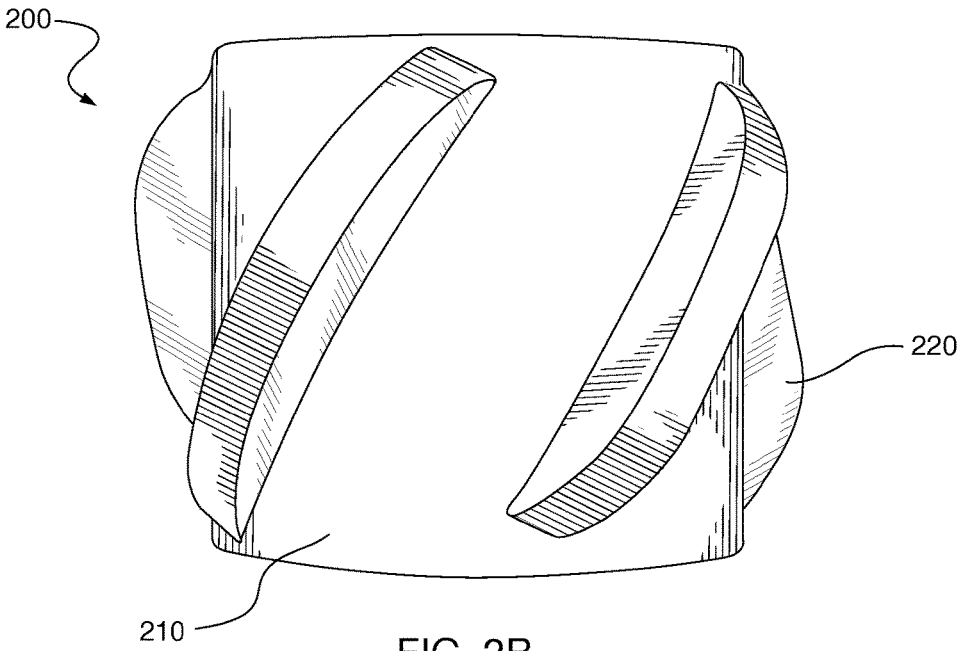
FIG. 2B is a side view of the casing centralizer of FIG. 2A.

FIG. 2A is a perspective view of a centralizer 200 as may be used in the present invention, in an alternate embodiment. The centralizer 200 may again be used for centering a tubular body such as a joint of casing or a liner string in a wellbore. The centralizer 200 has an outer surface 210 and an inner surface 215. FIG. 2B is a side view of the centralizer 200.

The centralizers 100, 200 generally have the same dimensions. Each centralizer 100, 200 includes a plurality of blades 120, 220 spaced around the outer surface 110, 210. In the arrangement of FIGS. 1A and 1B, the blades 120 are substantially vertical; in the arrangement of FIGS. 2A and 2B, the blades 220 are angled. In each case, the centralizers 100, 200 are fabricated substantially from a steel material as a solid body. Further, the blades 120, 220 define at least two ridges along the respective outer surfaces 110, 210 spaced equi-distantly around the centralizer 100, 200.

Figure 3:
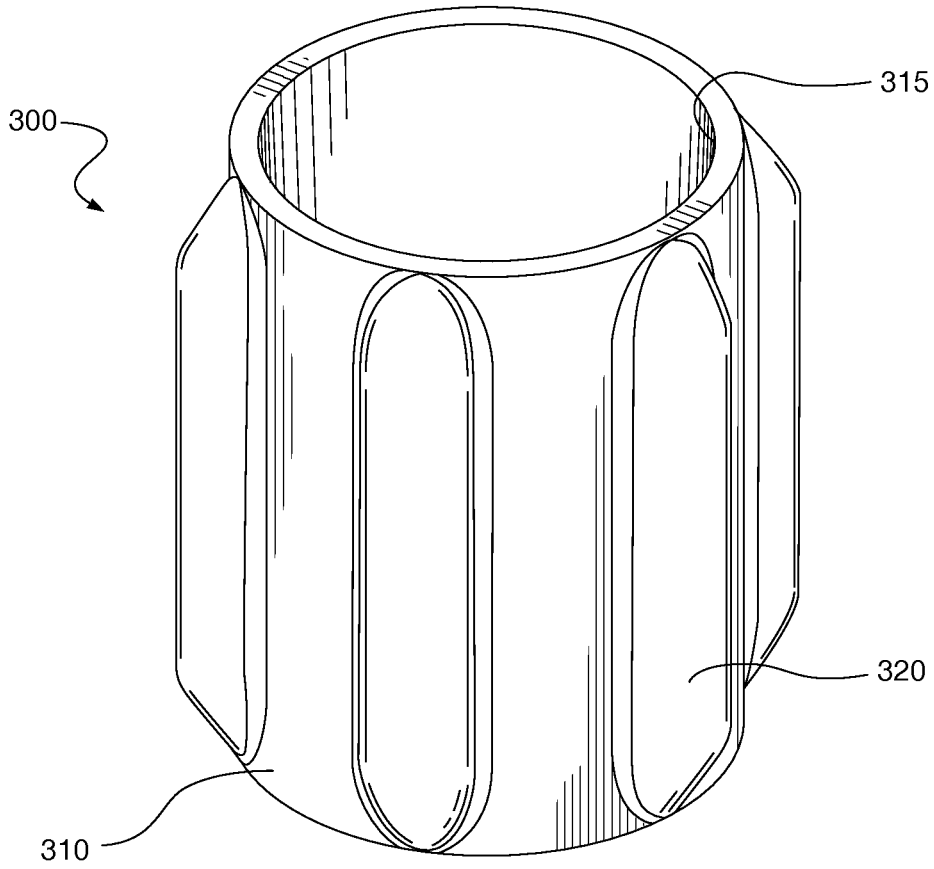
FIG. 3 is a perspective view of a casing centralizer as may be used in the present invention, in another alternate embodiment.

FIG. 3 is a perspective view of a casing centralizer 300 as may be used in the present invention, in an alternate embodiment. Upon information and belief, the illustrative centralizer 300 was designed by Top-Co Cementing Products, Inc. of Weatherford, Tex. The casing centralizer 300 has an outer surface 310 and an inner surface 315. Blades 320 reside around the outer surface 310 in spaced-apart relation.

Figure 4:
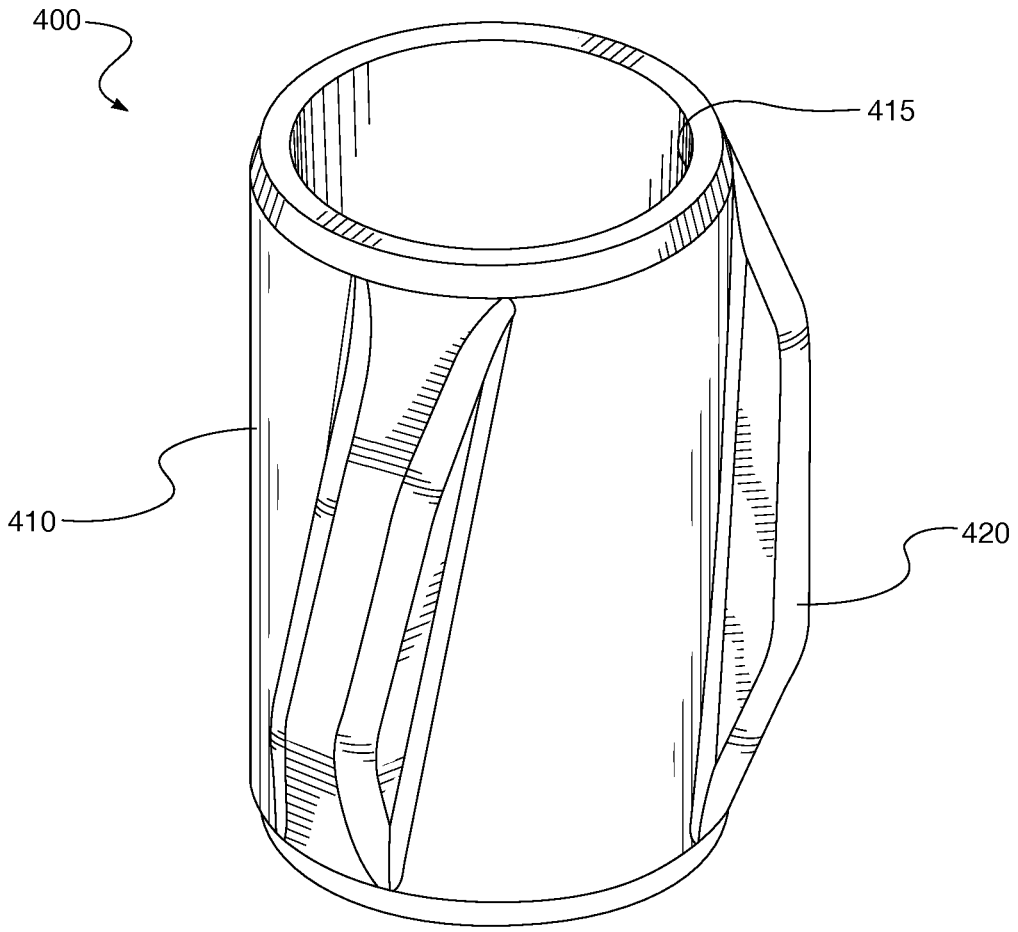
FIG. 4 is a perspective view of a casing centralizer as may be used in the present invention, in still another embodiment.

FIG. 4 is a perspective view of a casing centralizer 400 as may be used in the present invention, in still another embodiment. The illustrative centralizer 400 was also designed by Top-Co Cementing Products, Inc. of Weatherford, Tex. The casing centralizer 400 has an outer surface 410 and an inner surface 415. Blades 420 reside around the outer surface 410 in spaced-apart relation.

Figure 5:
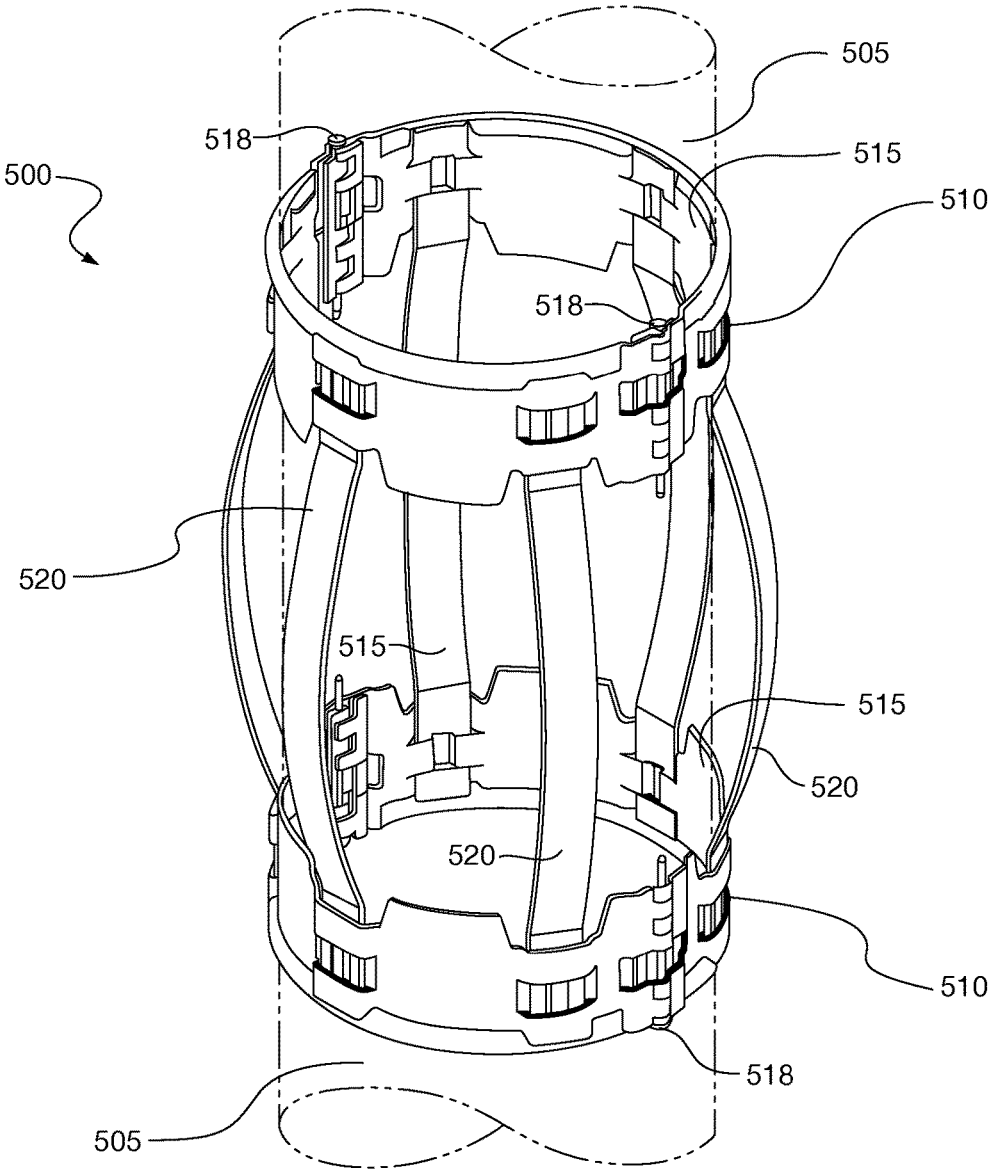
FIG. 5 is a side view of a centralizer as may be used in the methods of the present invention, in still another embodiment.

FIG. 5 is a side view of a centralizer 500 of the present invention, in another embodiment. The centralizer 500 has a pair of spaced-apart collars 510. The collars 510 are designed to circumferentially receive the tubular body. In the view of FIG. 5, a tubular body is shown at 505, and is intended to represent a casing joint. Ideally, the collars 510 fit loosely around the tubular body 505, allowing the collars 510 to slide over the outer diameter of the tubular body 505. Preferably, the collars 510 are identical.

The centralizer 500 also has a plurality of leaf springs 520. The leaf springs 520 are equi-distantly spaced, and are welded to the pair of collars 510 at opposing ends. The leaf springs 520 have capability to "comply" with the diameter of a wellbore by bowing in and out as the centralizer 500 moves down hole.

The leaf springs 520 may be attached to the collars 510 in any manner. Connection may be, for example, by welding or by interlocking components.

The collars 510 and the leaf springs 520 may be fabricated from steel, from a plastic material, or from a ceramic material. Any such material is suitable so long as the springs 520 have an element of elasticity to them, allowing them to bow in and out it as the centralizer 500 moves through a wellbore. The centralizer 500 may be used for centering a tubular body such as a joint of casing, a liner, a production tubing, an injection tubing, or a sand screen in a wellbore.

Each collar 510 is made up of hinged connected accurate sections, in this case two, adapted to be wrapped around the casing 505 and then suitably latched to one another by hinge pins 518, all as well-known in the art.

It is observed, that during the drilling of a borehole through underground formations, or during the running of a casing string into a wellbore, the string of pipe undergoes considerable rotational and sliding contact with the rock formations. Further, considerable relative rotation and translation occurs between the pipe string and the surrounding centralizers. Accordingly, in each of the illustrative centralizers 100, 200, 300, 400, 500, a low friction coating is applied at least to the inner surfaces 115, 215, 315, 415, 515.

In traditional drilling and completion operations, a lubricating drilling mud is pumped into the wellbore. The drilling mud may be either a water-based or an oil-based mud. Diesel and other mineral oils are also often used as lubricants. Minerals such as bentonite are known to help reduce friction between the pipe strings downhole and an open borehole. Materials such as Teflon have also been used to reduce friction, however these lack durability and strength. Other additives include vegetable oils, asphalt, graphite, detergents and walnut hulls, but each has its own limitations.

Yet another method for reducing the friction between a pipe string, typically a drill string and the borehole is to use a hard facing material (also referred to in the industry as "hardbanding"). U.S. Pat. No. 4,665,996, herein incorporated by reference in its entirety, discloses the use of hardbanding the bearing surface of a drill pipe with an alloy having the composition of: 50-65% cobalt, 25-35% molybdenum, 1-18% chromium, 2-10% silicon and less than 0.1% carbon for reducing the friction between the drill string and the rock matrix. As a result, the torque needed for rotary drilling operations is decreased. Another form of hardbanding is WC-cobalt cermets applied to a drill stem assembly. Other hardbanding materials include TiC, Cr-carbide, Nb-carbide and other mixed carbide, carbonitride, boride and nitride systems. Hardbanding may be applied to portions of a drill string or a directional drilling assembly using weld overlay or thermal spray methods.

To reduce the coefficient of friction between the joint of casing (such as casing 505) and the surrounding centralizer, and in lieu of the above known methods, it is proposed herein to coat the inner surface with a low-coefficient of friction material. The low-friction material is preferably a Molykote® anti-friction coating available from Dow Corning Corp. of Midland, Mich., having Molybdenum disulfide ($MoS_2$). Alternatively, it is proposed herein to create a low-coefficient of friction layer using a ferritic nitro-carburizing process that produces a polytetrafluoroethylene (PTFE) coating on all surfaces.

Ferritic nitro-carburizing ("FNC"), also known as soft nitriding, is applied to carbon steels, tool steels, alloy steels and stainless steels to provide anti-galling wear resistance. The procedure is used in the auto industry to improve the fatigue life of car parts. The procedure is also used to enhance the wear characteristics of forging and stamping dies, fixtures, gears and molds.

FNC is a form of heat treating. Different heat treating companies apply their own proprietary gas compositions, gas flow rates, and furnace temperatures to produce the right nitro-carburizing environment. Some companies have developed unique processes for nitriding, including so-called Salt Bath FNC, Fluidized-Bed FNC and Plasma (or Ion) FNC. However, it has been observed, particularly with Gaseous FNC where gas compositions are injected into a chamber at high temperatures, that the resulting coating creates an outer layer having very low relative friction.

Figure 6:
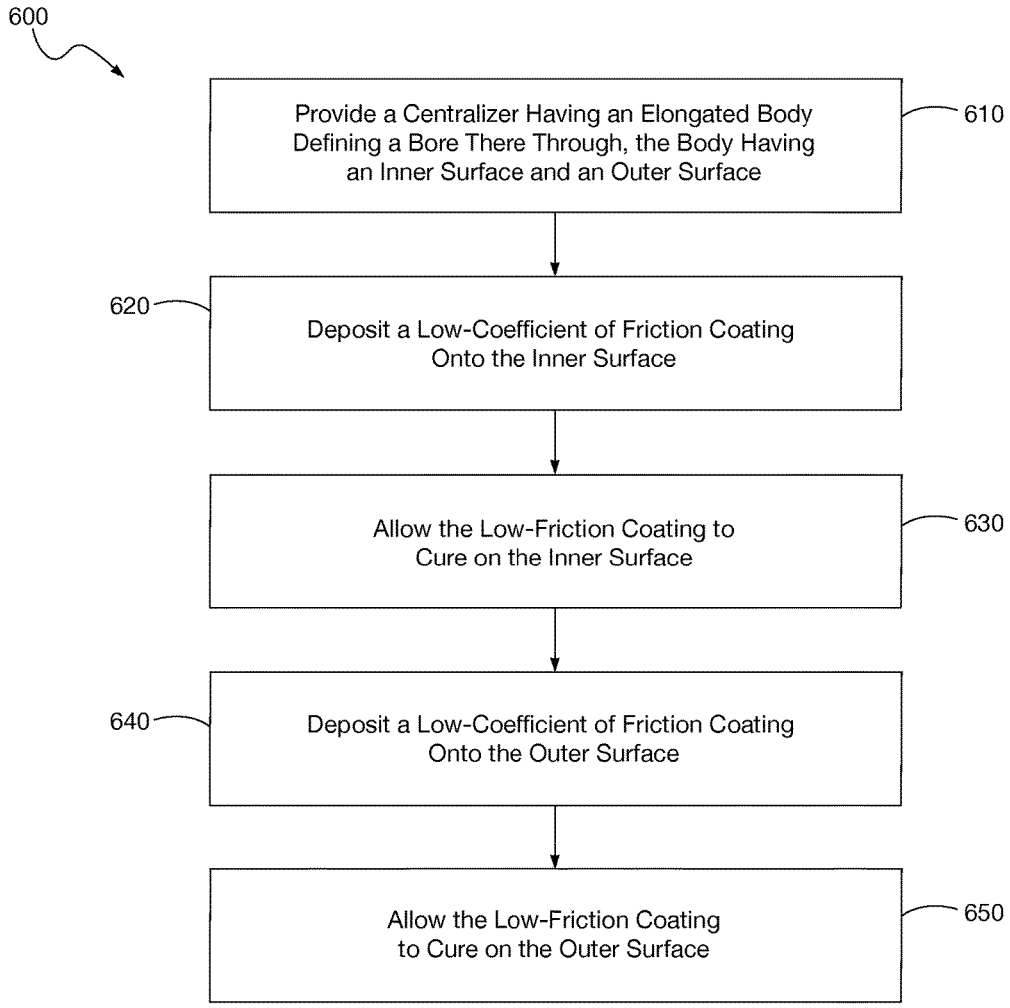
FIG. 6 is a flow chart showing steps for creating the centralizer of any of FIGS. 1 through 5, in one embodiment. The method involves placing a coating of low-friction material onto surfaces of the centralizer.
Figure 7:
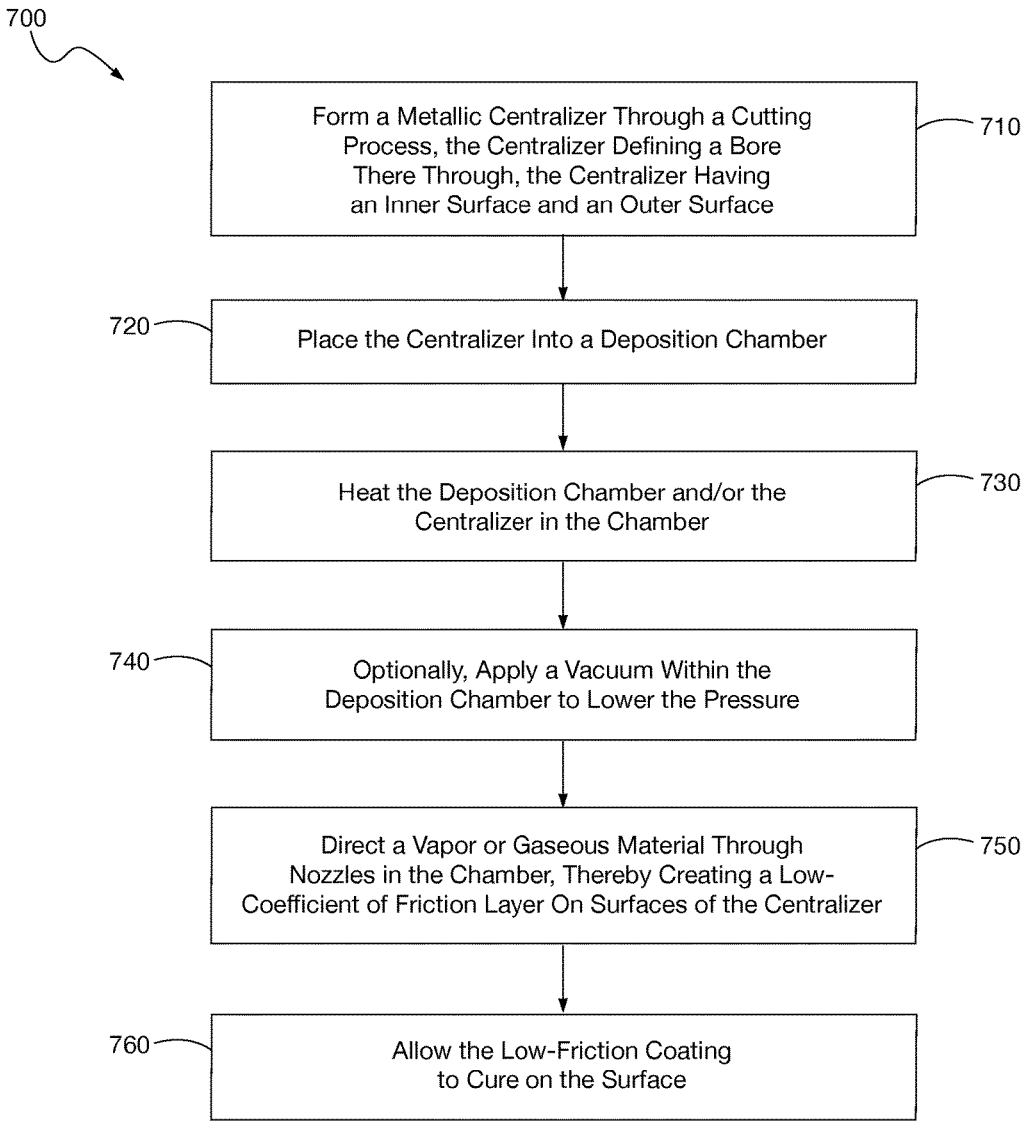
FIG. 7 is a flow chart showing steps for creating the centralizer of any of FIGS. 1 through 5, in an alternate embodiment. The method involves placing the centralizer into a deposition chamber and conducting physical vapor deposition.

FIGS. 6 and 7 present flow charts showing steps for methods of fabricating a centralizer, in alternate embodiments.

Referring first to FIG. 6, a first method 600 for fabricating a centralizer is provided. The method 600 first includes providing a centralizer. This is shown in Box 610. The centralizer comprises an elongated body having a bore there through. The bore is dimensioned to receive a tubular body such as a joint of casing. The elongated body has an inner surface and an outer surface. Preferably, the body is a substantially solid metallic material, though it may optionally include small perforations. The outer surface of the body may have two or more blades forming channels for carrying or directing a fluid.

The method 600 also includes depositing a low-coefficient coating onto the inner surface of the body. This is seen in Box 620. The coating is designed to provide a reduced coefficient of friction on the inner surface. In one aspect, the coating has a coefficient of friction that is about 0.1.

The low-friction material is preferably the Molykote® coating available from Dow Corning Corp. of Midland, Mich. In one aspect, the Molykote® 3402-C anti-friction coating is used. This coating is a blend of solid lubricants, corrosion inhibitors, and an organic binder dispersed in a solvent. This coating can be applied directly to a steel surface and will generally cure within 2 hours at room temperature, and in less than 10 minutes at higher temperatures.

The Molykote® 3402-C anti-friction coating forms a slippery film that covers the surface of the centralizer to reduce friction against the casing joint. Such an anti-friction coating is beneficial as it allows for a dry, clean lubricant between the steel pipe and the surrounding centralizer while being run down hole, reducing the drag coefficient.

The anti-friction coating may be brushed, dipped, heat sprayed, or cold wet sprayed onto the subject surface of the centralizer. Preferably, the coating is sprayed onto the surface using a centrifugal sprayer. The centralizer may be cooled while the coating is allowed to cure.

It is noted that additional Molykote® formulations may be used as the anti-friction coating. One such variety is the Molykote® 7400 anti-friction coating. This is a water dilutable coating that can be applied using a centrifugal sprayer, and then kiln dried at about 20° C. in about fifteen minutes. Preferably, the surface is pre-treated using phosphatization or sandblasting to increase adhesion. After application, a maintenance free coating is left.

Other low-friction coating materials include polytetrafluoroethylene (PTFE), or Teflon™. Alternatively, low-friction coating materials include perfluoroalkoxy polymer resin (PFA), fluorinated ethylene propylene copolymer (FEP), ethylene chlorotrifluoroethylene (ECTFE), and the copolymer of ethylene and tetrafluoroethylene (ETFE).

Other suitable low-friction materials include polyetheretherketone, carbon reinforced polyetheretherketone, polyphthalamide, polyvinylidene fluoride (PVDF), polyphenylene sulphide, polyetherimide, polyethylene (PE) and polysulphone.

Certain of the low-friction coating materials listed above are available in products under the brand names:

Molykote® available from Dow Corning Corp. of Midland, Mich. (as noted);

Wearlon™ available from Plastic Maritime Corp. of Wilton, N.Y.;

Halar® available from Solvay Solexis, Inc. of Thorofare, N.J.;

Kynar® available from Arkema, Inc. of King of Prussia, Pa.;

Vydax® and Silverstone™ available from E.I. Du Pont De Nemours and Co. of Wilmington, Del.;

Dykor® available from Whitford Corp. of West Chester, Pa.;

Emralon® available from Henkel Corp. of Rocky Hill, Conn.;

Electrofilm™ available from Orion Industries of Chicago, Ill.; and

Everlube® available from Metal Improvement Company, LLC of East Paramus, N.J.

In another aspect, a low-coefficient of friction coating is used that contains graphite or graphite powder. Graphite is an allotrope of carbon. Alternatively, the coating may include Molybdenum disulfide ($MoS_2$), which is a black crystalline sulfide of molybdenum. Alternatively still, the coating may include hexagonal Boron Nitride (hBN), also known as "White Graphite." This dry material in powder form is known to reduce friction between solid bodies. Combinations thereof may be used, applied using a brushing, dipping or spraying process.

The method 600 also comprises allowing the low-coefficient coating to cure on the inner surface. This is indicated at Box 630. Curing may be done by heating or by air drying. The low-coefficient coating may meet ASTM-D2714 or ASTM-D2625 standards to form a slippery film, optimizing metal-to-metal friction control.

Optionally, the method 600 further includes depositing a low-coefficient of friction coating onto the outer surface. This is seen in Box 640. Here, the coating is designed to provide a reduced coefficient of friction on the outer surface. The coating may be any of the low-friction coatings listed above.

The method 600 then comprises allowing the low-coefficient coating to cure on the outer surface. This is provided at Box 650.

It is observed that the above materials may be applied to the inner surface, the outer surface, or both, of a centralizer by first cleaning and degreasing the surface. The cleaner the surface, the better the highly lubricious material will adhere. The subject surface may then be lightly sanded or, alternatively, sand blasted, such as by using a 5-micron Alumina (Aluminum Oxide) powder. The centralizer is then manually cleaned using a soft cloth. Then, the centralizer is again sand blasted, but this time with a selected dry lubricating powder, or combinations thereof, therein. Blasting may be done, for instance, at 120 psi using clean and cold pneumatic air. The centralizer is sprayed until the outer surface begins to change color, e.g., silver-gray. The surface is then again lightly buffed.

In another aspect, the surfaces of the centralizer are coated with an ultra-low friction diamond-like-carbon (DLC) coating. The DLC coating may be chosen from tetrahedral amorphous carbon (ta-C), tetrahedral amorphous hydrogenated carbon (ta-C:H), diamond-like hydrogenated carbon (DLCH), polymer-like hydrogenated carbon (PLCH), graphite-like hydrogenated carbon (GLCH), silicon containing diamond-like carbon (Si-DLC), metal containing diamond-like carbon (Me-DLC), oxygen containing diamond-like carbon (O-DLC), nitrogen containing diamond-like carbon (N-DLC), boron containing diamond-like carbon (B-DLC), fluorinated diamond-like carbon (F-DLC), or combinations thereof.

The DLC coatings may be deposited by physical vapor deposition. The physical vapor deposition coating methods include RF-DC plasma reactive magnetron sputtering, ion beam assisted deposition, cathodic arc deposition and pulsed laser deposition (PLD). In sputter deposition, a glow plasma discharge (usually localized around a source material by a magnet) bombards the material, sputtering some material away as a vapor for subsequent deposition. In cathodic arc deposition, a high-powered electric arc is discharged at a source material to blast away portions into a highly ionized vapor, that is then deposited onto a work piece. In ion (or electron) beam deposition, the material to be deposited is heated to a high vapor pressure by electron bombardment in a high-vacuum environment, and then transported by diffusion to be deposited by condensation on the (cooler) work piece. In pulsed laser deposition, a high-power laser ablates material from a target (source material) into a vapor. The vaporized material is then transported to the work piece and deposited.

Chemical vapor deposition may also be used as a coating technique. Chemical vapor deposition coating methods include ion beam assisted CVD deposition, plasma enhanced deposition using a glow discharge from hydrocarbon gas, using a radio frequency glow discharge from a hydrocarbon gas, plasma immersed ion processing and microwave discharge. Plasma enhanced chemical vapor deposition (PECVD) is one advantageous method for depositing DLC coatings on large areas at high deposition rates. Plasma-based CVD coating process is a non-line-of-sight technique, i.e. the plasma covers the part to be coated and the entire exposed surface of the part is coated with uniform thickness.

In an alternate embodiment of the method 600, the step 620 is modified so that the low-coefficient coating is sand blasted onto the surface rather than deposited. In this instance, the step 630 of allowing the coating to cure is replaced with a step of buffing the surface.

FIG. 7 provides a second method of manufacturing a casing centralizer. FIG. 7 is a flow chart showing steps for a method 700 of manufacturing a centralizer, in an alternate embodiment. The centralizer is fabricated from a metal material, such as steel. The method 700 employs a vapor deposition process.

The method 700 first involves forming a centralizer through a milling (or cutting) process. This is provided at Box 710. As an alternative, a molding process may be employed. The centralizer is formed to have a bore defining inner and outer surfaces. The inner surface is dimensioned to lightly engage the outer surface of a wellbore pipe. Preferably, the outer surface comprises blades equi-distantly spaced about an outer diameter of the centralizer.

The method 700 also includes placing the centralizer into a vapor deposition chamber. This is shown at Box 720.

The method 700 further includes a heating step. This is indicated at Box 720.

Heating may mean heating the chamber to a temperature in excess of 750° F. More preferably, heating means heating the chamber to about 950° F. to 1,150° F. The processing of heating the chamber also heats the metal material making up the centralizer.

Alternatively, the heating step of Box 720 may mean heating the centralizer directly. This may be by using a plasma torch. The plasma torch enables heating of the downhole device to a very high temperature, even in excess of 2,500° F.

The method 700 may optionally include applying a vacuum within the deposition chamber. This is seen at Box 740. Applying a vacuum serves to lower the pressure in the chamber, thereby assisting the vapor deposition process. In one aspect, the pressure is lowered to between about one and ten tons.

As a next step in the method 700, a vapor is injected into the deposition chamber. This is provided at Box 750. It is understood that vapor may be a gas that is below its critical temperature. Preferably, the vapor is injected through one or more atomizing nozzles. A gaseous mixture comprising nitrogen and carbon may be injected through the one or more nozzles.

In one aspect, each nozzle injects a different inert gas. In another aspect, a pre-mixed composition of gases is injected through each of the nozzles. Gases may include ammonia, carbon, hydrogen and other gases. In any event, the gas atoms locate onto the centralizer structure. Further, during the heating step 730, the metal material making up the centralizer expands, allowing the gaseous mixture to penetrate into the structure of the metal material as nano-particles. It is preferred that the heating and vapor deposition process be conducted over a period of about one hour. Thus, the method 700 also includes continuing to heat the deposition chamber after vapor deposition.

After heating, the deposition chamber and the centralizer located therein are allowed to cool. This is provided at Box 760. As the centralizer cools within the deposition chamber, the inert nano-particles become trapped or embedded into the metal material, primarily at the surface of the centralizer. In this way, a non-friction coating is formed along both inner and outer surfaces of the centralizer. (It is understood that for purposes of this disclosure, the term "coating" includes any layer proximate a surface of the centralizer.)

The method 700 may be a Gaseous FNC process. The gases injected through the nozzles may include carbon, nitrogen, ammonia and an endothermic gas. The centralizer is preferably cleaned using a vapor degreasing process, and then nitrocarburized at a chamber temperature of between about 950° F. to 1,150° F. The FNC process may be the method disclosed in U.S. Patent Publ. No. 2011/0151238, entitled "Low-Friction Coating System and Method." That application is referred to and incorporated herein by reference in its entirety. The application teaches a method that includes the steps of:

- ferritic nitro-carburizing a metal substrate to form a surface of the metal substrate including a compound zone and a diffusion zone disposed subjacent to the compound zone;
- after ferritic nitro-carburizing, oxidizing the compound zone to form a porous portion defining a plurality of pores;
- after oxidizing, coating the porous portion with polytetrafluoroethylene; and
- after coating, curing the polytetrafluoroethylene to thereby form the low-friction coating.

It is preferred that a first coating be applied using a nitriding process. The nitriding process may be an FNC process whereby nano-particles comprising nitrogen and carbon are diffused into the metal surfaces of the centralizer. Ammonia may be used as a nitrogen source. The surfaces are allowed to cool. Thereafter, a second coating is applied that contains graphite or molybdenum disulfide. Alternatively, the second coating may be a diamond-like-carbon (DLC) coating or PTFE.

Figure 8:
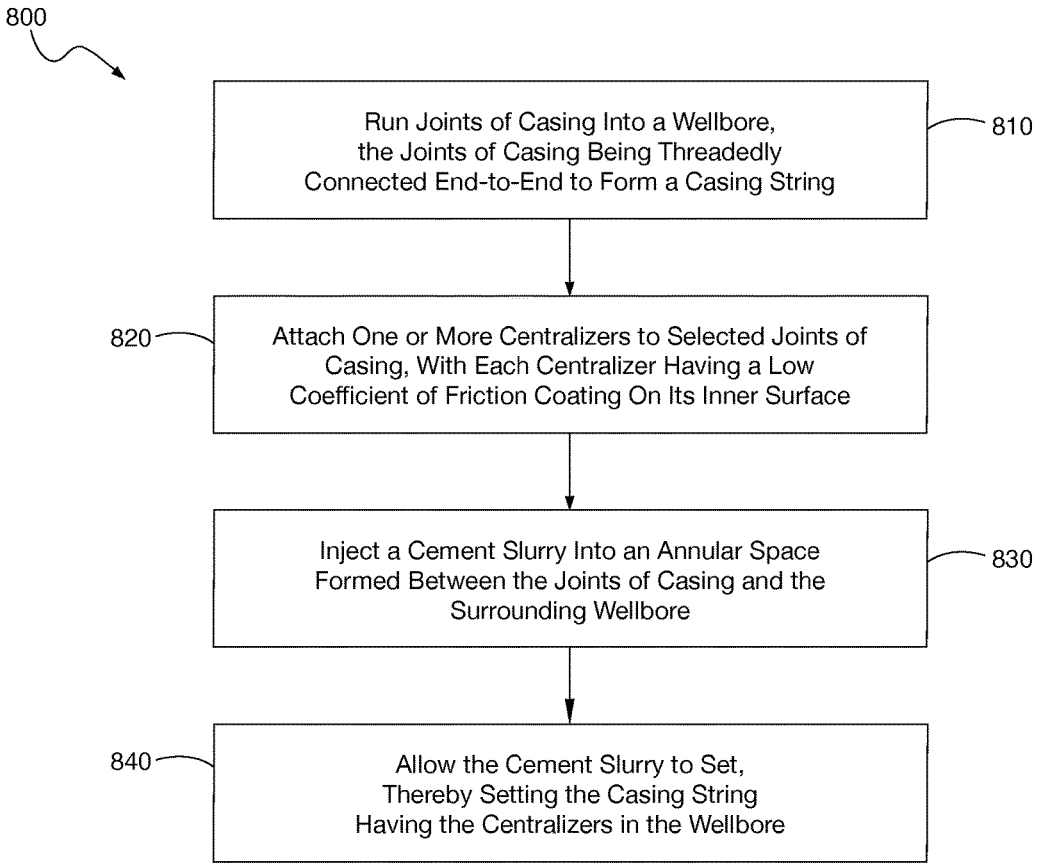
FIG. 8 is a flow chart showing steps for setting a casing string in a wellbore, in one embodiment.

A method of setting casing in a wellbore is also provided herein. FIG. 8 is a flow chart showing steps for a method 800 of setting a casing string in a wellbore, in one embodiment.

The method 800 first comprises running joints of casing into a wellbore. This is shown in Box 810. The joints of casing are threadedly connected end-to-end as they are lowered into the wellbore.

The method 800 also includes attaching one or more centralizers to selected joints of casing as the joints of casing are lowered into the wellbore. This is provided in Box 820. Each of the one or more centralizers comprises an elongated body having a bore there through. The bore is dimensioned to slidingly receive a joint of casing. The elongated body has an inner surface and an outer surface.

In a preferred aspect, each of the centralizers is a substantially solid and metallic body having blades equi-distantly spaced around the outer surface. Each of the centralizers has a coating deposited on at least the inner surface, wherein the coating is designed to provide a reduced coefficient of friction. The coating may be any of the coatings described or listed above. Additional technical information concerning low-friction coatings in the context of downhole operations is provided in U.S. Pat. No. 8,220,563 entitled "Ultra-Low Friction Coatings for Drill Stem Assemblies," the entire disclosure of which is incorporated herein by reference.

In one aspect, the coefficient of friction is lower on the inner surface after curing or after buffing than on the outer surface.

The method 800 further includes injecting a cement slurry into an annular space formed between the joints of casing and the surrounding wellbore. This is indicated at Box 830. Injecting the slurry generally means pumping the cement slurry down a bore of the casing string, down to a cement shoe or bottom of the casing string, and back up the annular space.

The method 800 also includes allowing the cement slurry to set. This is provided at Box 840. In this way, the casing string with the centralizers is set in the wellbore.

It is noted that the centralizers presented above in FIGS. 1 through 5 are merely illustrative. Any centralizer design may be used with the low-friction coating to reduce the drag and torque coefficients of friction between the casing and the centralizers. Preferably, the coefficient of friction is less than 0.15. More preferably, the coefficient of friction is less than about 0.10.

As can be seen, an improved centralizer is offered that reduces the coefficient of friction between a joint of casing in a wellbore, and a surrounding centralizer. The reduced coefficient of friction enables the centralizer to move along an outer surface of casing joints without damaging the casing or creating stress joints. Dimensions of the centralizer may be adjusted during manufacturing for use on hard-banded drill pipe. The ferritic nitro-carburizing process is preferred, followed by a second coating comprising graphite, molybdenum disulfide, PTFE, or a diamond-like-carbon on all surfaces. The ferritic nitro-carburizing process beneficially increases the durability of the centralizer for its wellbore operations.

It will be appreciated that the inventions herein are susceptible to modification, variation and change without departing from the spirit thereof.

I claim:

1. A method of fabricating a centralizer, comprising:

providing a centralizer, the centralizer comprising an elongated metal body having an inner surface and an outer surface, wherein the inner surface defines a bore that is dimensioned to slidingly receive a tubular body, and the outer surface defines centralizing members dimensioned to direct the elongated body concentrically within a surrounding wellbore;

heating the centralizer to cause the metal material making up at least the inner and outer surfaces of the centralizer to expand;

applying a first low-coefficient of friction treatment to the inner surface and the outer surface using a ferritic nitro-carburizing process, wherein the ferritic nitro-carburizing process causes nitrogen and carbon atoms to diffuse into the inner and outer surfaces, thereby producing a reduced coefficient of friction along the inner and outer surfaces;

allowing the centralizer to cool along the surfaces;

depositing a second low-coefficient of friction treatment to at least the inner surface, the second treatment comprising coating comprising graphite, Molybdenum disulfide ($MoS_2$), a diamond-like-carbon, polytetrafluoroethylene (PTFE), or combinations thereof placed over the inner surface and the outer surface; and allowing the second low-friction treatment to cure.

2. The method of claim 1, wherein providing the centralizer comprises forming the centralizer through a milling process.

3. The method of claim 1, wherein:

the elongated body is a substantially solid body fabricated from steel;

the inner surface comprises a smooth inner wall of the elongated body, and the outer surface comprises the outer surfaces of two or more blades disposed equidistantly around the outer surface of the body;

the centralizing members comprise the blades, which form channels for directing a fluid; and the first and second treatments together provide a coefficient of friction for the inner surface and the outer surface each below about 0.15.

4. The method of claim 1, wherein the second treatment further comprises a coating of (i) perfluoroalkoxy polymer resin (PFA), (ii) fluorinated ethylene propylene copolymer (FEP), (iii) ethylene chlorotrifluoroethylene (ECTFE), (iv) a copolymer of ethylene and tetrafluoroethylene (ETFE), (v) polyetheretherketone, (vi) carbon reinforced polyetheretherketone, (vii) polphthalamide, (iii) polyvinylidene fluoride (PVDF), (ix) polyphenylene sulphide, (x) polyetherimide, (xi) polyethylene, or (xii) polysulphone.

5. The method of claim 1, wherein the second treatment is applied to both the inner surface and the outer surface by spraying, brushing, dipping or combinations thereof to form the surface coating.

6. The method of claim 1, wherein:

depositing the second treatment comprises blasting the coating as a dry lubricant powder onto at least the inner surface; and allowing the second low-coefficient of friction treatment to cure comprises buffing the surface.

7. The method of claim 1, wherein:

applying the first treatment to the inner and outer surfaces further comprises:

placing the centralizer into a deposition chamber;

heating the centralizer in the deposition chamber to cause the metal material making up at least the inner and outer surfaces of the centralizer to expand; and injecting nitrogen and carbon gases through one or more nozzles and into the deposition chamber, wherein atoms of the vises locate onto the centralizer surfaces and diffuse into the metal material.

8. The method of claim 7, further comprising:

reducing the pressure in the deposition chamber before or during the step of injecting the nitrogen and carbon gases.

9. The method of claim 7, wherein heating the centralizer comprises heating the deposition chamber to a temperature of at least 750° F., wherein the heating causes the metal material making up the inner and outer surfaces of the centralizer to expand.

10. The method of claim 9, wherein:

the gases further comprise ammonia; and heating the centralizer comprises heating the deposition chamber to a temperature of between about 850° F. and 1,200° F.

11. The method of claim 10, wherein the coating of the second treatment comprises (i) perfluoroalkoxy polymer resin (PFA), (ii) fluorinated ethylene propylene copolymer (FEP), (iii) ethylene chlorotrifluoroethylene (ECTFE), (iv) a copolymer of ethylene and tetrafluoroethylene (ETFE), (v) polyetheretherketone, (vi) carbon reinforced polyetheretherketone, (vii) polyphthalamide, (viii) polyvinylidene fluoride (PVDF), (ix) polyphenylene sulphide, (x) polyetherimide, polyethylene, or polysulphone.

12. The method of claim 7, wherein heating the centralizer comprises directly heating the centralizer using a plasma torch.

13. The method of claim 7, wherein the centralizer is heated and receives the gases for a period of about one hour.

* * * * *